US007071809B2

(12) United States Patent
Davis et al.

(10) Patent No.: US 7,071,809 B2
(45) Date of Patent: Jul. 4, 2006

(54) THERMAL FUSE CONTAINING BIMETALLIC SENSING ELEMENT

(75) Inventors: George D. Davis, Bellevue, WA (US); Byron G. Scott, Arlington, WA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/303,219

(22) Filed: Nov. 25, 2002

(65) Prior Publication Data

US 2004/0100354 A1 May 27, 2004

(51) Int. Cl.
*H01H 37/54* (2006.01)

(52) U.S. Cl. ..... 337/356; 337/343; 337/365

(58) Field of Classification Search ..... 337/356, 337/333, 343, 362, 365, 380, 405; 29/622
See application file for complete search history.

(56) References Cited

U.S. PATENT DOCUMENTS

| | | | | |
|---|---|---|---|---|
| 1,894,746 | A * | 1/1933 | Johnson | 337/403 |
| 2,300,142 | A * | 10/1942 | Wood | 337/164 |
| 3,656,080 | A | 4/1972 | Wells | |
| 4,350,967 | A * | 9/1982 | Doherty, Jr. | 337/343 |
| 4,363,016 | A * | 12/1982 | Unger | 337/56 |
| 4,527,144 | A * | 7/1985 | Arikawa | 337/407 |
| 4,554,525 | A | 11/1985 | Bayer | |
| 4,758,876 | A * | 7/1988 | Calenda et al. | 257/665 |
| 5,182,538 | A * | 1/1993 | Muller | 337/102 |
| 6,037,071 | A | 3/2000 | Poirier et al. | |
| 6,091,315 | A * | 7/2000 | Hofsass | 337/13 |
| 6,191,680 | B1 * | 2/2001 | Hofsass | 337/362 |
| 6,396,381 | B1 * | 5/2002 | Takeda | 337/377 |

FOREIGN PATENT DOCUMENTS

| | | |
|---|---|---|
| GB | 1 018 422 A | 1/1966 |
| WO | WO 00 34971 | 6/2000 |

* cited by examiner

*Primary Examiner*—Anatoly Vortman
(74) *Attorney, Agent, or Firm*—Black Lowe & Graham PLLC

(57) ABSTRACT

A non-resetable, bimetallic thermal switch. The bimetallic thermal switch includes a bimetallic element, first and second electrical contacts, and a component for electrically connecting and disconnecting the first and second electrical contacts based on movement of the bimetallic element. The switch also includes a non-resetable component configured to disallow electrical reconnection of the first and second electrical contacts after an electrical disconnection has occurred between the first and second electrical contacts.

8 Claims, 2 Drawing Sheets

THERMAL FUSE CONTAINING BIMETALLIC SENSING ELEMENT

BACKGROUND OF THE INVENTION

Some commercially available thermal fuses have limited temperature capability. These thermal fuses use a solder that is alloyed to melt at a desired trip temperature. The solder is suspended between two points in a circuit (bridge). The solder "bridge" melts and falls away at the trip temperature, thereby opening the circuit (fuse). Other thermal fuses use the same solder, but contain a spring and contact bar. When the solder reaches its melting temperature, the spring pushes the bar away from the contacts thereby opening the circuit. Thus, solder fuses are not resetable, which is important for many applications. However, there is potential for the solder bridge to migrate back into place under vibration or changes in unit orientation, causing a re-closure of the switch to occur. Also, solder-type thermal fuses have a limited temperature range due to the melting point of the alloyed solder.

Bimetallic thermal switches can be designed to trip over a range of temperature much greater than solder-type fuses. The setpoint for a bimetallic thermal switch is based on the type of bimetallic material used and the forming process of the bimetallic material. Although bimetallic switches can be produced to trip over a great range of temperatures, they are resetable. Bimetallic thermal switches toggle back to the "On" position (closed contacts) when the temperature drops below the trip value. However, many applications require that the thermal switch stays open even if the temperature returns to normal.

Therefore, there is an unmet need for unresetable thermal switches that can be used over a wide temperatures range.

SUMMARY OF THE INVENTION

A non-resetable, bimetallic thermal switch is provided. The bimetallic thermal switch includes a bimetallic element, first and second electrical contacts, and a component for electrically connecting and disconnecting the first and second electrical contacts based on movement of the bimetallic element. The switch also includes a non-resetable component configured to disallow electrical reconnection of the first and second electrical contacts after an electrical disconnection has occurred between the first and second electrical contacts.

In one aspect of the invention, the non-resetable component is a spring-loaded stopper that disallows resetting motion of the bimetallic element.

In a second aspect of the invention, the non-resetable component is a high-temperature non-conductive material that interrupts an electrical connection between the first and second electrical contacts after the first and second electrical contacts have been disconnected.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

The present invention is a nonresetable, bimetallic thermal switch. The trip temperature for a bimetallic thermal switch is based on the characteristics of a bimetallic disk that is included within the thermal switch. Bimetallic disks can be manufactured to trip at a temperature over a range of temperatures greater than solder-type thermal switches.

Figure 1A:
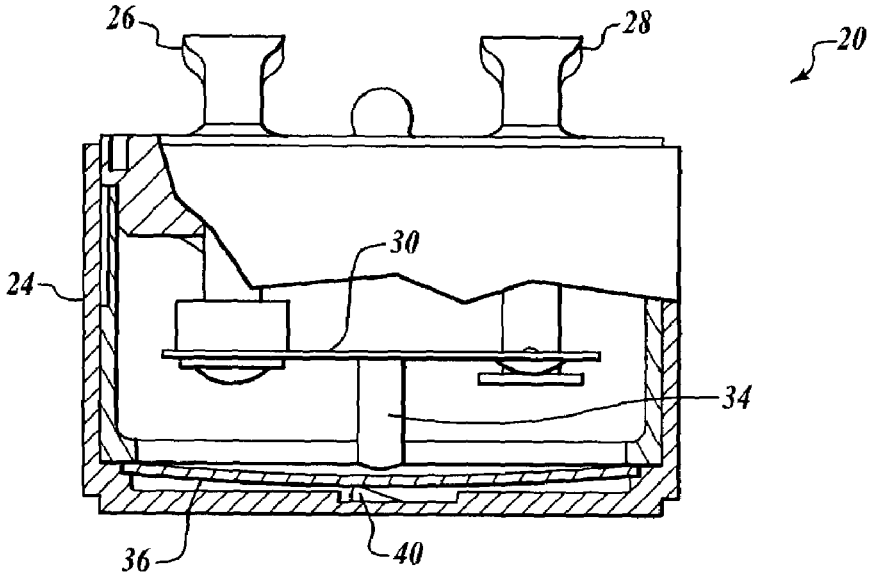
FIGS. 1A and B illustrate a first embodiment of a bimetallic thermal switch formed in accordance with the present invention.

FIGS. 1A and B illustrate an embodiment of a non-resetable, bimetallic thermal switch 20 formed in accordance with the present invention. The non-resetable, bimetallic thermal switch 20 includes a hermetically sealed housing 24 that includes electrical terminals 26 and 28 that extend from outside the housing 24 to inside the housing 24. A flexible conducting beam 30 physically and electrically attaches to the first terminal 26 within the housing 24. A non-conducting plunger 34 is attached to the conducting beam 30 at some predefined distance from the first terminal 26. A bimetallic disk 36 is located at a base of the interior of the housing 24. When the thermal switch 20 is experiencing temperatures below the temperature threshold of the bimetallic disk 36, the bimetallic disk 36 is not in contact with the plunger 34. Below the threshold temperature for the bimetallic disk 36, the bimetallic disk 36 is concave relative to the plunger 34. When the bimetallic disk 36 is not in contact with the plunger 34, the conducting beam 30 maintains electrical contact with the second terminal 28. This is the normal "ON" operation of the switch 20. In this position, the bimetallic disk 36 maintains pressure on a spring-loaded stopper 40 due to the disk being in a convex configuration relative to the stopper 40. The spring-loaded stopper 40 is attached to the base of the interior of the housing 24. The spring-loaded stopper 40 provides a force that wants to push the stopper 40 into an upright position or a position predominately orthogonal to the bimetallic disk 36. The force of the bimetallic disk 36 placed on the stopper 40 overcomes the force of the stopper 40.

Figure 1B:
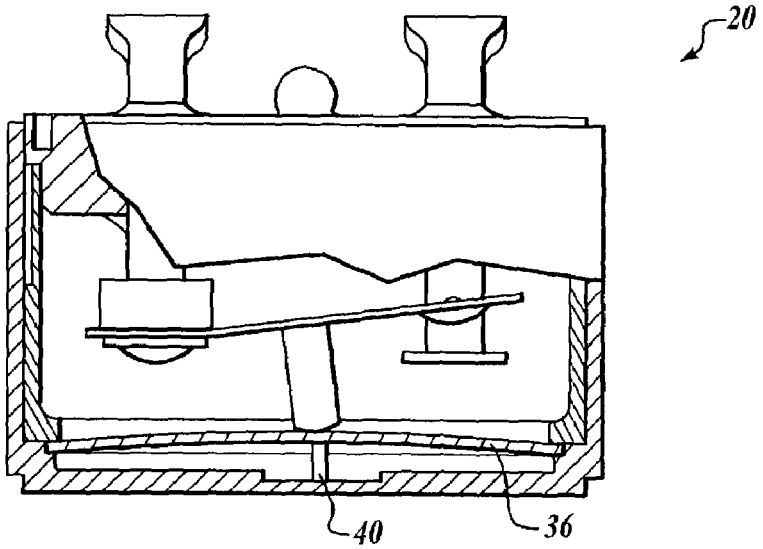

FIG. 1B illustrates the switch 20 after the threshold temperature has been reached. Once the threshold temperature has been reached, the bimetallic disk 36 change shapes or snaps into contact with the plunger 34, thereby disconnecting the conducting beam 30 from the second terminal 28 and opening the switch 20. The bimetallic disk 36 is now in a concave position relative to the spring-loaded stopper 40, thereby allowing the stopper 40 to spring into a position that is approximately orthogonal to the bimetallic disk 36 at approximately the center of the bimetallic disk 36. The stopper 40 is made of a material, such as without limitation Inconel®, that has enough strength to overcome any resetting force (i.e., if the temperature drops below the threshold temperature) of the bimetallic disk 36. Therefore, the stopper 40 keeps the bimetallic disk 36 in contact with the plunger 34 thereby keeping the switch 20 open even if the temperature drops below the threshold temperature.

Figure 2A:
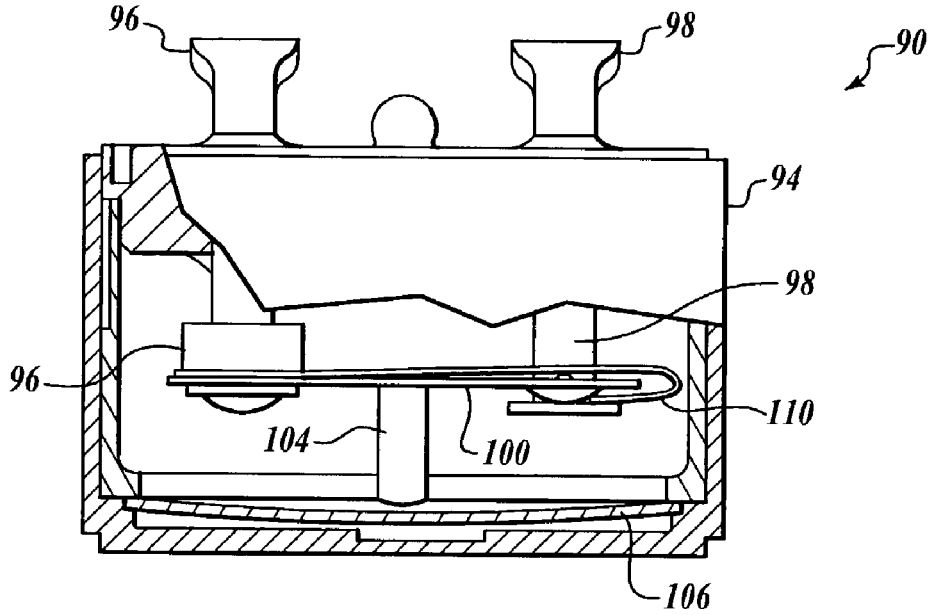
FIGS. 2A and B illustrate a second embodiment of a bimetallic thermal switch formed in accordance with the present invention.

FIGS. 2A and B illustrate another embodiment of a nonresetable, bimetallic thermal switch 90. The non-resetable, bimetallic thermal switch 90 includes a hermetically sealed housing 94 that includes electrical terminals 96 and 98 that extend from outside the housing 94 to inside the housing 94. A flexible conducting beam 100 attaches to the first terminal 96 within the housing 94. A plunger 104 is attached to the conducting beam 100 at some predefined distance from the first terminal 96. A bimetallic disk 106 is located at a base of the interior of the housing 94. A high-temperature plastic piece 110 is suitably attached to the conducting beam 100, an interior wall of the housing 94 or another component within the housing 94. As shown in FIG. 2A, when the switch 90 is experiencing temperatures below the threshold temperature, the conducting beam 100 electrically connects the first terminal 96 to the second terminal 98. Also, the high-temperature plastic piece 110 is spring-loaded to produce a force at the connection between the connecting beam 100 and the second terminal 98. The force the piece 110 applies at the connection between the beam 100 and the second terminal 98 is not enough to overcome the force the beam 100 applies to the second terminal 98.

Figure 2B:
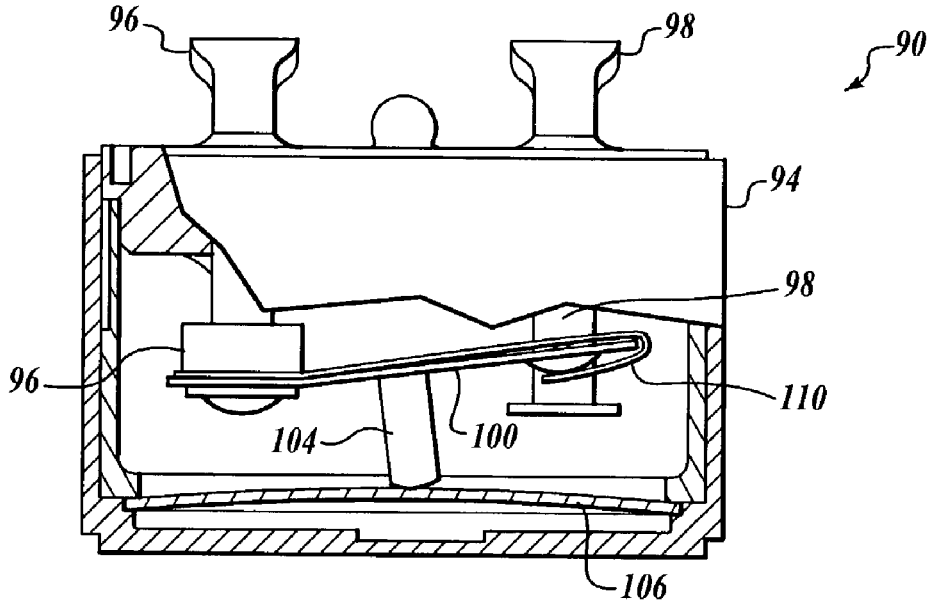

As shown in FIG. 2B, the temperature threshold has been reached and the bimetallic disk 106 toggles or snaps and places pressure on the plunger 104, thereby forcing the conducting beam 100 to disconnect from the second terminal 98. The piece 110 springs to a position between the conducting beam 100 and the second terminal 98. Now, if the temperature drops back below the threshold temperature for the metallic disk 106, the disk 106 stops putting pressure on the plunger 104, and the piece 110 prevents the conducting beam 100 from electrically connecting with the second terminal 98. A non-limiting example of the high-temperature plastic piece 110 is a Kapton strip.

It will be appreciated that various other configurations of the electrically interrupting piece shown in FIGS. 2A and B or bimetallic disk preventers, such as that shown in FIGS. 1A and B, can be used for preventing reset of a bimetallic thermal switch.

While the preferred embodiment of the invention has been illustrated and described, as noted above, many changes can be made without departing from the spirit and scope of the invention. Accordingly, the scope of the invention is not limited by the disclosure of the preferred embodiment.

The embodiments of the invention in which an exclusive property or privilege is claimed are defined as follows:

1. A bimetallic thermal switch comprising:

a bimetallic disk;

first and second electrical contacts;

a component for electrically connecting and disconnecting the first and second electrical contacts based on movement of the bimetallic element; and a non-resetable component configured to disallow electrical reconnection of the first and second electrical contacts after an electrical disconnection has occurred between the first and second electrical contacts, wherein the component for electrically connecting and disconnecting the first and second contacts includes a stem being physically separated from the disk when electrically connecting the contacts and being physically connected to the disk when electrically disconnecting the contacts.

2. The switch of claim 1, wherein the non-resetable component includes a device for disallowing resetting motion of the bimetallic element.

3. The switch of claim 2, wherein the device includes a spring-loaded stopper.

4. The switch of claim 3, wherein the stopper includes nickel-base alloy with chromium and iron.

5. The switch of claim 1, wherein the bimetallic element is set to change shape at a predefined temperature.

6. The switch of claim 1, wherein the non-resetable component includes a temperature-resistant, non-conductive material for interrupting an electrical connection between the first and second terminals after the first and second terminals have been disconnected.

7. The switch of claim 6, wherein the high-temperature non-conductive material includes a temperature-resistant plastic.

8. The switch of claim 7, wherein the temperature-resistant plastic includes Kapton.

* * * * *